US006899622B2

(12) United States Patent
Lind et al.

(10) Patent No.: US 6,899,622 B2
(45) Date of Patent: May 31, 2005

(54) ELECTRONIC PULL TAB GAMING SYSTEM

(75) Inventors: Clifton Lind, Austin, TX (US); Jefferson C. Lind, Austin, TX (US); Joseph Richard Enzminger, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 33 days.

(21) Appl. No.: 10/037,178

(22) Filed: Oct. 23, 2001

(65) Prior Publication Data

US 2002/0098882 A1 Jul. 25, 2002

Related U.S. Application Data

(60) Provisional application No. 60/242,497, filed on Oct. 23, 2000.

(51) Int. Cl.[7] ..... A63F 9/24

(52) U.S. Cl. ..... 463/17; 463/42

(58) Field of Search ..... 463/16–22, 12–13, 463/25, 40–42; 273/138.1, 144 R

(56) References Cited

U.S. PATENT DOCUMENTS

| | | | | |
|---|---|---|---|---|
| 5,037,099 A | | 8/1991 | Burtch | |
| 5,042,809 A | | 8/1991 | Richardson | |
| 5,239,165 A | * | 8/1993 | Novak | 463/17 |
| 5,324,035 A | | 6/1994 | Morris et al. | |
| 5,487,544 A | | 1/1996 | Clapper, Jr. | |
| 5,536,008 A | | 7/1996 | Clapper, Jr. | |
| 5,580,311 A | | 12/1996 | Haste, III | |
| 5,595,538 A | | 1/1997 | Haste, III | |
| 5,609,337 A | | 3/1997 | Clapper, Jr. | |
| 5,645,485 A | | 7/1997 | Clapper, Jr. | |
| 5,749,784 A | | 5/1998 | Clapper, Jr. | |
| 5,810,664 A | | 9/1998 | Clapper, Jr. | |
| 5,871,398 A | * | 2/1999 | Schneier et al. | 463/16 |
| 5,928,082 A | | 7/1999 | Clapper, Jr. | |
| 5,941,771 A | | 8/1999 | Haste, III | |
| 5,949,042 A | | 9/1999 | Dietz, II et al. | |
| 5,980,385 A | | 11/1999 | Clapper, Jr. | |
| 5,984,779 A | | 11/1999 | Bridgeman et al. | |
| 6,024,640 A | | 2/2000 | Walker et al. | |
| 6,056,289 A | | 5/2000 | Clapper, Jr. | |
| 6,220,961 B1 | | 4/2001 | Keane et al. | |

OTHER PUBLICATIONS

Definition of operative, The American Heritage Dictionary of the English Language, Third Edition, copyright 1992.*

* cited by examiner

*Primary Examiner*—Mark Sager
(74) *Attorney, Agent, or Firm*—Russell D. Culbertson; The Culbertson Group, P.C.

(57) ABSTRACT

A gaming system produces a multiple-play physical pull tab ticket at the request of a player. Each chance in the game is associated with a game play record which has been produced and stored in the system prior to the sale of the physical game ticket. A player in the game selects a number of game play outcomes or plays to be purchased and the gaming system responds to the request by producing and distributing to the player a pull tab ticket having the requested number of game play outcomes printed or otherwise formed on a ticket substrate. Game play information specifying the outcomes of each game play printed on the game ticket may be printed or otherwise encoded on the game ticket. A player terminal may read this game play information using a suitable scanning device and may then display the results of the plays to the player.

31 Claims, 6 Drawing Sheets

ELECTRONIC PULL TAB GAMING SYSTEM

CROSS-REFERENCE TO RELATED APPLICATION

This application is related to U.S. provisional patent application Ser. No. 60/242,497, filed October 23, 2000 and entitled "Cashless Gaming System With Printed Game Ticket." The Applicants hereby claim the benefit of this provisional patent application under 35 U.S.C. §119(e). The entire content of this provisional application is incorporated herein by this reference.

TECHNICAL FIELD OF THE INVENTION

The present invention relates to an electronic gaming system utilizing a physical game ticket to distribute chances or outcomes in the game. The invention includes a gaming method and program product, and also includes a gaming system for implementing the gaming method.

BACKGROUND OF THE INVENTION

Among the various games of chance available in many jurisdictions is a game referred to as "pull tab." The traditional pull tab game is played with a large number of physical tickets or cards manufactured before the start of the game. Each pull tab ticket is printed with several symbols or indicia arranged in some identifiable pattern. The printed indicia are initially covered or obscured by some material such as a removable paper sheet or tab, or a scratch off material. The pattern of indicia printed on the cards is correlated to an outcome in the game and the pull tab tickets themselves represent game play records. Some of the pull tab tickets in a given pull tab game are printed with a pattern of indicia that correlates to some prize or winning outcome whereas some tickets are printed with a pattern of indicia correlating to no prize. In order to participate in the game, players purchase the preprinted pull tab tickets at a gaming establishment, remove the ticket cover material, and then read the uncovered indica pattern to determine if the ticket wins in a prize. Winning tickets may be redeemed at the gaming establishment.

Although traditional pull tab is a popular game, the game is played fairly slowly. Each pull tab ticket representing a single chance in the game must be purchased and the player must physically remove the cover material to determine if the respective ticket is a winning ticket. Also, traditional pull tab is limited in that the results of a chance in the game are displayed only through the indicia printed on the pull tab ticket. U.S. Pat. Nos. 5,980,385 and 5,941,771, for example, show electronic pull tab systems that attempt to overcome some of the problems associated with traditional pull tab games. These electronic pull tab gaming systems provide an electronic display for displaying results which are also printed on the pull tab ticket. Although these electronic pull tab gaming systems may show the results of a purchased pull tab ticket in a more animated and thus more interesting and exciting manner than is possible using a physical ticket alone, these prior systems are still limited as to the rate at which the game may be played.

SUMMARY OF THE INVENTION

It is an object of the invention to provide a gaming method and gaming system that overcome the deficiencies associated with prior electronic pull tab gaming systems. More particularly, it is an object of the invention to provide a gaming method and gaming system that maintains the essential characteristics of a pull tab game while allowing rapid play in a secure and verifiable environment.

These objects are accomplished in the present gaming system by producing a multi-play physical pull tab ticket at the request of a player. Each chance in the game or game play outcome is associated with a game play record which has been produced and stored electronically in the system prior to the sale of the physical game ticket. A player in the game selects a number of game play outcomes or plays to be purchased and the gaming system responds to the request by producing and distributing to the player a pull tab ticket having the requested number of game play outcomes applied on a ticket substrate in the form of some directly identifiable or readable indicia. The game play outcomes are chosen at random from the game play records which were produced prior to the start of the game. This randomization may be accomplished by selecting ordered game play records at random or by randomizing an ordered set of game play records and selecting game play records sequentially from the randomized set.

Each game play ticket is also preferably printed or encoded with machine readable game play information. This game play information specifies each game play outcome represented on the ticket. That is, the game play information specifies whether each game play outcome is a losing outcome or a winning outcome, and also specifies any prize associated with a winning outcome. This information on each game play outcome may be specified directly or indirectly in the game play information encoded on the game ticket. Whether the information on each game play outcome is directly or indirectly specified in the game play information encoded on the game ticket, the encoded game play information may be read from the game ticket at a player terminal or other device to show the results of the game ticket. In particular, the results of the game ticket may be provided or displayed to the player at a player terminal which employs some animated display. The player terminal reads the game play information from the game ticket and then waits for the player to enter play requests. Each play request represents a request for the player terminal to display another game play outcome which has been printed on the player's game ticket. Each such request also represents a redemption request in the preferred account-based system as described further below. Alternatively to providing the results of the game ticket one game play outcome at a time at a player terminal, the preferred gaming system also provides point of sale terminals which can read the game play information from the ticket and show the player the cumulative effect of the various game play outcomes represented on the game ticket. Obtaining ticket results at a point of sale terminal represents an alternate redemption request in the preferred account-based system. Of course, since the game is a pull tab game, the player may also simply read the indicia representing the game play outcomes directly from the game ticket and match those outcomes to a prize table to determine the results of the game ticket.

One advantage of the present gaming method and system is the manner in which the outcome may be displayed at a player terminal. Although the gaming system utilizes a printed pull tab ticket, the player terminal display used to portray the game play outcomes to the player is not limited to displays simply showing the pull tab ticket. Rather, the player terminal displays may be designed to imitate other types of games, including traditional casino games. This ability to imitate other games combined with the ability to apply many game play outcomes or plays on a single game ticket facilitates rapid play in a manner that enhances player interest and excitement.

One preferred form of the gaming system according to the invention utilizes player accounts to facilitate game ticket purchases and apply winnings. Once a player sets up and appropriately funds their account, the player need only request a game ticket and specify a quantity of game play outcomes to be obtained. If the player account has sufficient funds to pay for the number of game play outcomes requested, the system produces the ticket with the requested game play outcome quantity, and then issues the newly created pull tab ticket to the player. Thus, both the purchase of the game ticket and the application or distribution of winnings may be cashless transactions relying on the previously created player account. Using player accounts further increases the rate at which the game may be played and provides further flexibility in imitating other games. The cashless or account-based system also provides enhanced security for the players and provides excellent fraud protection for the gaming establishment.

These and other objects, advantages, and features of the invention will be apparent from the following description of the preferred embodiments, considered along with the accompanying drawings.

DESCRIPTION OF THE PREFERRED EMBODIMENTS

Figure 1:
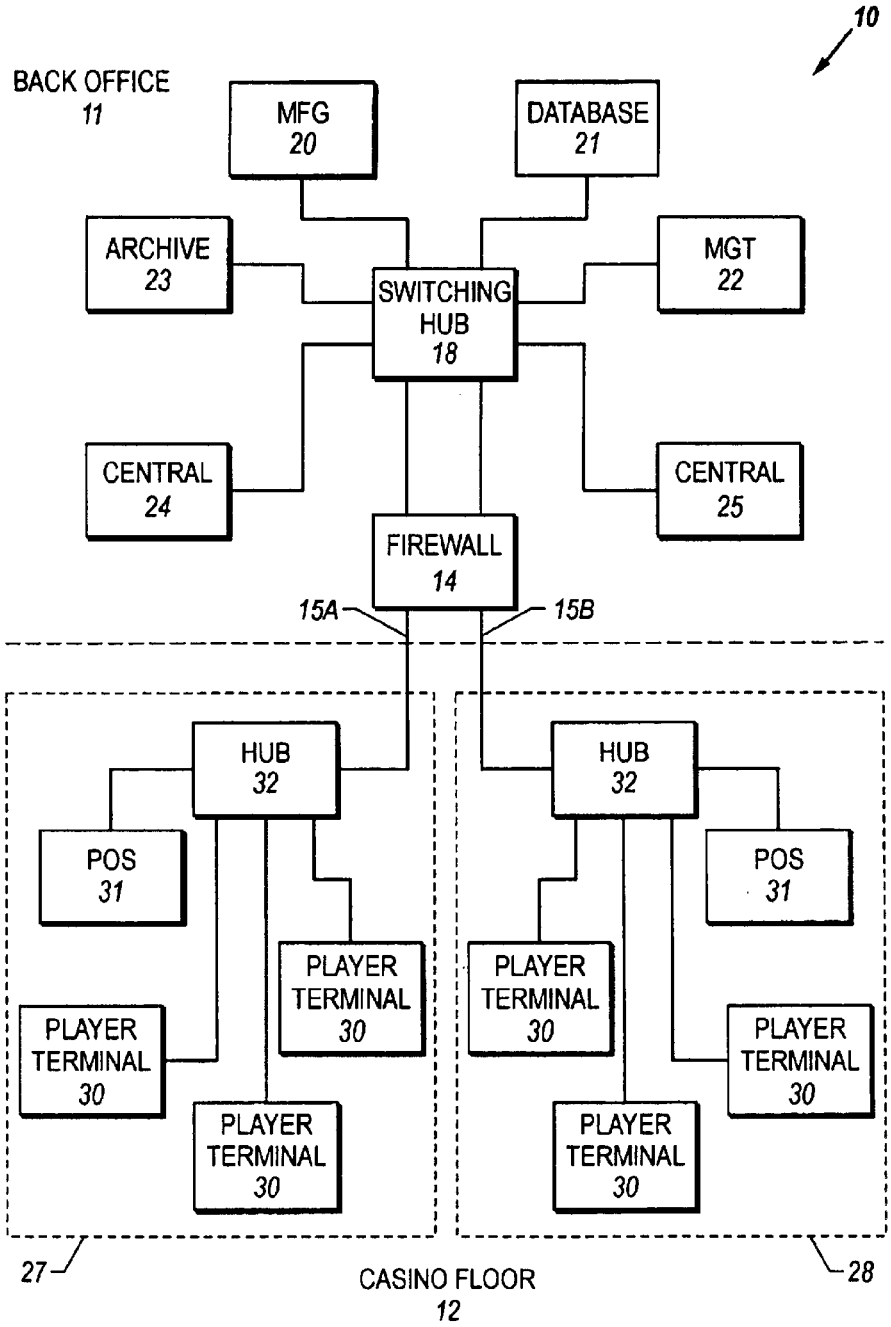
FIG. 1 is a diagrammatic representation of a gaming system embodying the principles of the invention.

Referring to FIG. 1, a gaming system 10 embodying the principles of the invention includes a back office system 11 located in a secure area and a casino floor system 12 that is accessible to the public. Casino floor system 12 allows players to establish and modify accounts in gaming system 10 and allows players to participate in various games available through the gaming system. Back office system 11 maintains accounts and account balances for all players, maintains account information, and provides system usage reports and other reports useful in managing gaming system 10. Back office system 11 also preferably creates game sets made up of a number of predetermined game records and selects game records in response to player requests made through casino floor system 12.

A secure communications arrangement is used to facilitate communications between back office system 11 and casino floor system 12. Security may be enhanced with hardware firewalls 14 connected in the communications lines 15*a* and 15*b* which extend to casino floor system 12 and/or by firewall software operating on the various computers that make up back office system 11.

Back office system 11 includes a number of separate processing devices interconnected through a suitable communications arrangement. In the illustrated form of the system, back office system 11 comprises a local area network of individual processing devices and includes a switching hub 18 to which each separate processing device connects. The two floor system communication links 15*a* and 15*b* also connect into switching hub 18. Although other types of computer network communications hubs may be used within the scope of the invention, a switching hub is preferred to allow the various system components to communicate simultaneously with fewer conflicts and thus with increased overall system performance.

The illustrated preferred form of the invention shown in FIG. 1 includes a manufacturing computer 20, a database computer 21, a management computer 22, an archive computer 23, and two separate central computers 24 and 25. Manufacturing computer 20 manufactures game sets, divides the game sets into a number of subsets, and stores the unused subsets until requested by one of the central computers 24 or 25. Manufacturing computer 20 also receives used subsets back from the various central computers and, once all of the subsets are used, stores the used game set at archive computer 23. The structure of the game sets as well as the structure of individual game records in the game sets and subsets will be discussed further below.

Each central computer 24 and 25 is programmed to communicate with a particular group of casino floor devices. FIG. 1 shows two separate groups of casino floor devices, group 27 and group 28, for purposes of example. Central computer 24 is programmed to communicate with each of the casino floor devices in group 27, while central computer 25 is programmed to communicate with each of the casino floor devices in group 28.

Each central computer 24 and 25 stores subsets of game records from manufacturing computer 20 for use by the casino floor devices as described below. Each central computer also receives information from the various casino floor devices in the respective group and stores this information in the database computer 21. For example, central computer 24 receives requests from devices in group 27 to open a player account, add funds to a player account, and withdraw funds from a player account. Central computer 24 also receives requests for game records or plays from devices in group 27 and sends game record information to devices in the group.

The multiple central computer arrangement shown in FIG. 1 provides several advantages. First, in the event that one of the central computers 24 or 25 experiences a technical problem which prevents it from operating properly, only a single group of casino floor devices is affected. Second, the multiple central computer arrangement shown in FIG. 1 is readily scalable to increase or decrease the number of casino floor devices supported by the system. Furthermore, the multiple central computer arrangement allows faster communications with the casino floor devices and therefore increases the speed at which a player may play games offered through gaming system 10.

Database computer 21 serves as a data storage repository for holding all player records and system usage information. Database computer 21 stores in its associated memory a player account table having entries corresponding to the various player accounts. The player account information includes, for example, the player's name, the player's account identifier or number, in some cases a personal identification number for the player, and perhaps other player information personal to the particular player. The database computer may also collect and store usage information indicating the casino floor devices that each player has used and the extent of use. A data storage device associated with database computer 21 may also be used to store ticket identifiers for the various game tickets made according to the invention and a set of ticket data. The sets of ticket data are correlated to the respective ticket identifiers and define the game records and/or game play outcomes assigned to the respective game tickets as described further below.

Numerous different database structures will be apparent to those of ordinary skill in database development and application. The invention encompasses any suitable database structure for maintaining the player information, ticket information, and other information used in the operation of gaming system 10.

Management computer 22 operates under the control of management software to provide system reports including real-time reports and system usage and performance reports of interest to the system operators, managers, or regulators. The software executed at management computer 22 also may be used to schedule administrative functions required or helpful for the database computer system 21. Management computer 22 may include a suitable it display for providing a user interface and for displaying reports and other information. Although not shown in FIG. 1, a printer may also be included in the back office portion of the network or may be connected directly to management computer 22 for printing system reports and usage records.

Once manufacturing computer 20 receives all of the game subsets back from the central computers 24 and 25 for a given game set, the manufacturing computer sends the entire used game set to archive computer 23. Archive computer 23 serves as a repository for used game sets. Archive computer 23 is also preferably used to store a copy of each complete unused game set as well. The unused game sets may be copied from manufacturing computer 20 immediately after they are created. These unused game set copies and used games sets may be archived or stored in any suitable fashion in a nonvolatile memory device or storage device associated with the archive computer 23.

Referring now to the casino floor devices shown in FIG. 1, each group 27 and 28 includes a number of player terminals 30 and a point-of-sale or cashier terminal (POS) 31, all connected to a local area network communications hub 32. Although not shown in the figure, each group may also include one or more remote point-of-sale (RPOS) terminals, and one or more kiosks also connected to the communications hub 32. The communications hub 32 of each casino floor group is connected to switching hub 18 of the back office system 11 through one of the communications lines 15*a* or 15*b*.

Figure 2:
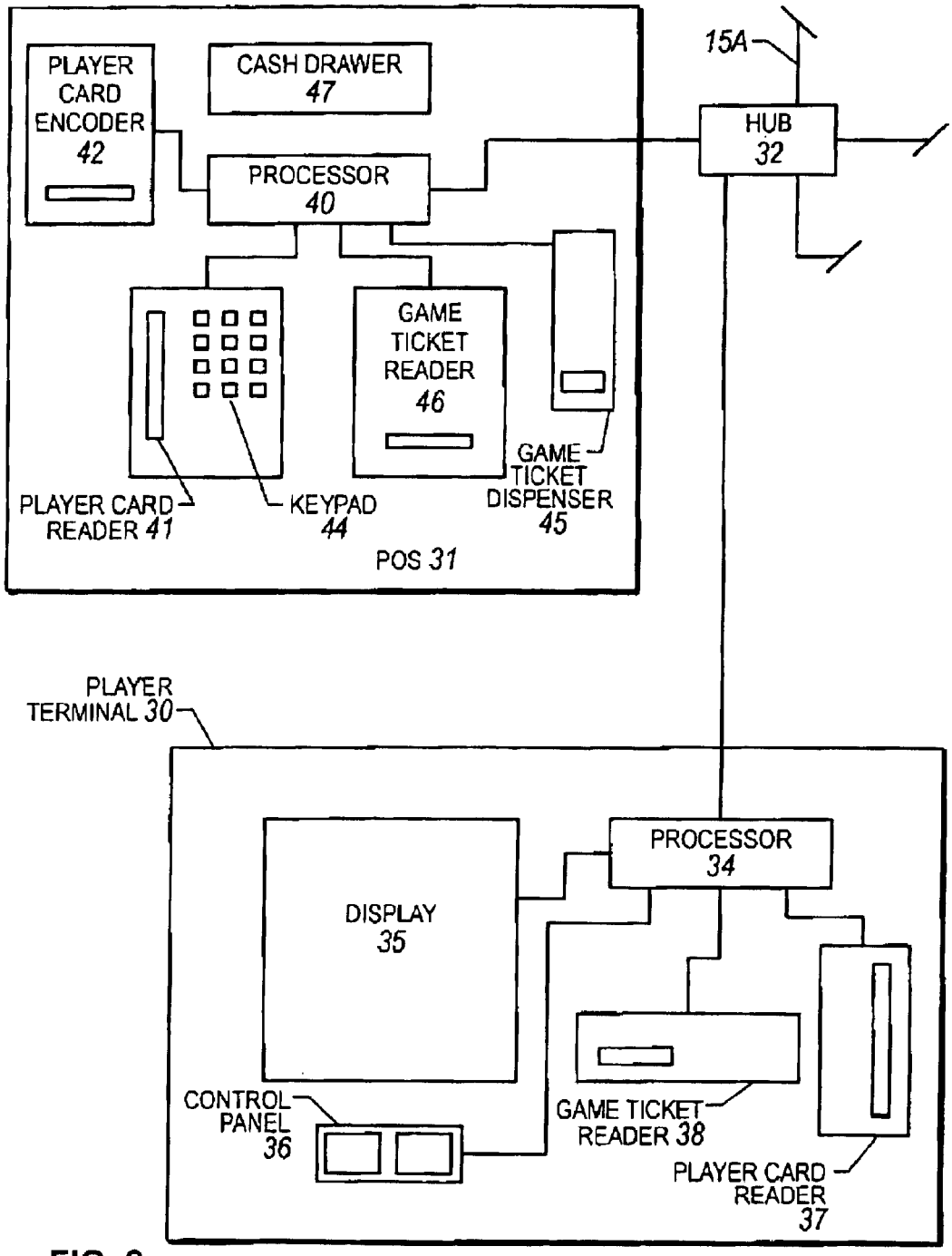
FIG. 2 is a diagrammatic representation of the point-of-sale terminal and player terminal included in the present gaming system.

As shown in FIG. 2, each player terminal 30 includes a computer system having a processor 34, touch screen display 35, a two-button control panel 36 (call attendant and play as buttons), a player card reader 37, and a game ticket reader 38. Player terminal software or program code executed by processor 31 receives information from player card reader 37 to log a player into the respective central computer (24 or 25), and to operate the game ticket reader to read the player's game ticket. The player terminal program code also causes display 35 to show graphic game representations indicating the results of game play. According the illustrated account-based form of the invention, each game play has been previously purchased by the player using a POS terminal or other device included in the casino floor system 12. Further information on the operation of the player terminals will be described below of reference to FIG. 5.

The POS terminal 31 shown in FIG. 2, enables a player to open an account with the gaming system, add funds to their account, close or cash out their account, purchase game tickets, and redeem or provide results for game tickets. POS terminal 31 comprises a computer system having a processor 40 and a player/cashier interface including a player card reader 41, player card printer/encoder 42, a receipt printer 43, keypad 44, game ticket printer/encoder/dispenser (game ticket dispenser) 45, and a game ticket reader/verifier 46. POS terminal 31 also includes a cash drawer 47 which is accessible by a POS cashier or attendant. Processor 40 included in POS terminal 31 executes operational software or program code to perform the steps shown in FIG. 4.

Figure 3A:
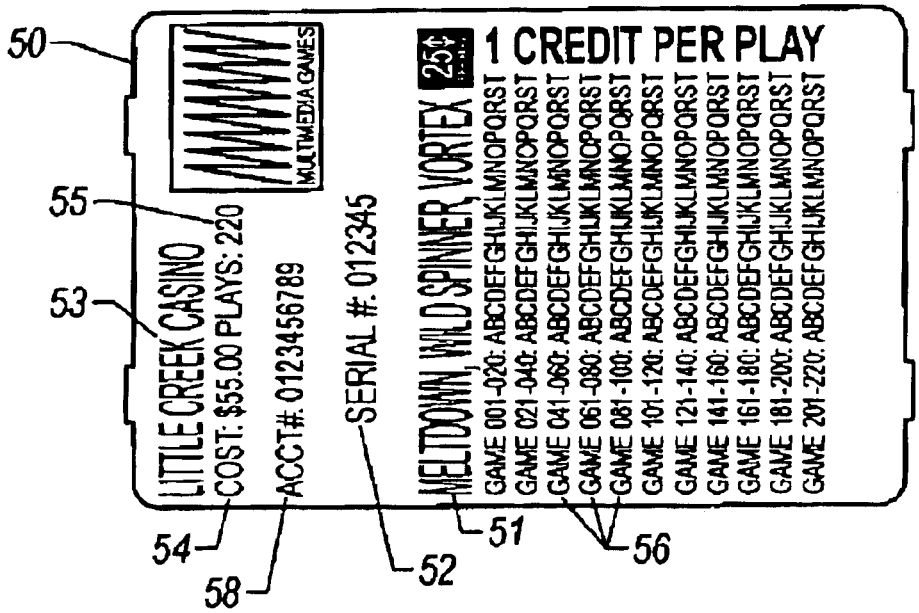
FIG. 3A is a diagrammatic representation of one side of a game ticket according to the invention.
Figure 3B:
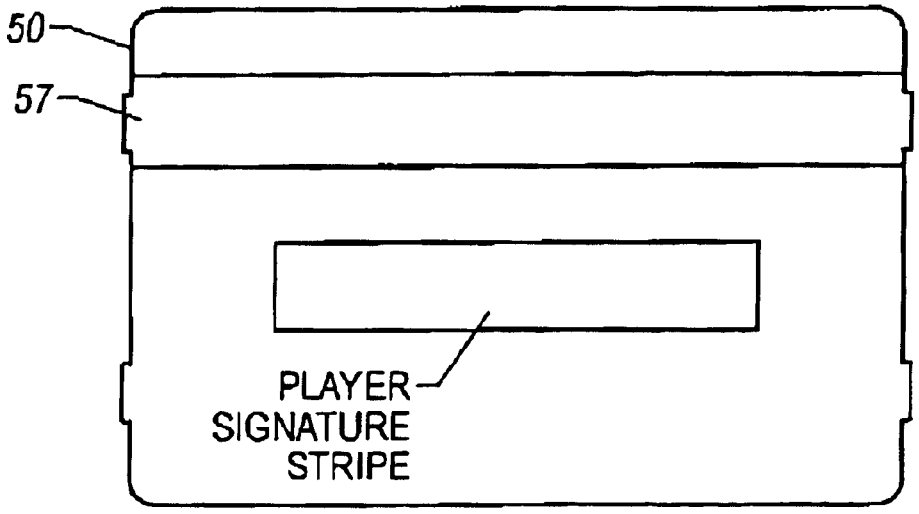
FIG. 3B is a diagrammatic representation of the opposite side of the game ticket shown in FIG. 3A.

Each game ticket 50 in the illustrated form of the invention includes a ticket substrate having a printed side shown in FIG. 3A and a magnetic stripe side shown in FIG. 3B. Each ticket contains a number of ticket indicia, each representative of a game play outcome (pull tab). These game play outcomes are purchased in a quantity at the discretion of the player and each game play outcome is associated with one of the predetermined game records produced at manufacturing computer 20. The printed side of the ticket shown in FIG. 3A preferably includes the game name 51, ticket identifier or serial number 52, casino name 53, price of the ticket 54, a play quantity comprising a value equal to the number of outcomes purchased 55, a player account number 58, and the printed ticket indicia representing the game play outcomes. The illustrated ticket indicia are printed in the form of a sequential list of prize indexes or result codes 56. These preferred prize indexes or result codes 56 are selected from a set of available codes listed in a prize table for the indicated game. Regardless of their specific form, the ticket indicia are directly identifiable, that is, identifiable to the player without the aid of any decoding machine. Although all of the information printed on the game ticket may be printed at the POS terminal, some forms of the invention may use partially preprinted tickets and print at the POS terminals only information which is specific to the particular game ticket such as the prize indexes or indicia 56.

The magnetic stripe side of ticket 50 includes a stripe of magnetic data storage medium 57 which is preferably encoded at a POS terminal 31 with machine readable game play information which specifies the game play outcomes printed on the game ticket and preferably identifies the game plays or records assigned to the game ticket. In one embodiment of the gaming system, the game play information includes the game serial number, the starting game record identifier identifying the starting game record purchased by the player, and the number of game play outcomes purchased. This starting game record identifier plus the number of game play outcomes/game records in the game set sequence (a randomized game record sequence) after the starting record effectively specifies each game record and thus each game play outcome represented on the given game ticket. In an alternate embodiment, the game play information includes a ticket serial number or identifier which relates to a ticket data table or set of ticket data stored in the database computer 21 or elsewhere in the back office system 11. This set of ticket data specifies or identifies each game play outcome associated with the respective game ticket and preferably each assigned game record itself. In these first two alternatives the game play information indirectly specifies or identifies the game play records assigned to the same ticket. Still other alternatives of the game ticket 50 may include the prize indexes or result codes from the purchased game records themselves encoded in some machine readable fashion on the magnetic medium 57. These latter alternatives may be thought of as directly identifying the game records in the machine readable information by using data from the assigned game records themselves.

The ticket indicia, which in the illustrated case comprise indexes or result codes 56, printed on the printed side of ticket 50 and perhaps other information on the printed side of the ticket may be covered with some material when the ticket is initially dispensed. The material may be a covering which may be scratched off to reveal the ticket indicia 56 or may be a sheet of material which may be peeled off to reveal the ticket indicia. This covering may not be required under the applicable gaming regulations, and may be omitted as desired.

Each game set preferably produced at manufacturing computer 20 comprises a data structure including header information identifying the game set and perhaps the game or games with which the game set is associated. In addition to the header information, each game set data structure includes a number of game records, each representing a chance in the particular game. Each game record itself comprises a data structure including a game record identifier and a game record or game play outcome. The game record identifier uniquely identifies each record in a game set, and the game play outcome indicates whether the record is a winning or losing record. In the preferred form of the invention each game play outcome comprises the result index or result code discussed above with reference to the game tickets 50. Other information may also be included in the game records, such as for example, sequence information to identify the record's sequence in the game set and prize amount information.

Operation of the Gaming System

When a player opens an account in the gaming system, they receive their player card and preferably set a personal identification number (PIN) for the account. Player information including the player's name, their account identifier or number, and PIN are stored in back office system 11, and specifically in a player account table stored in a data storage device associated with database computer 21. The player's account identifier is encoded on the player card so that account access may be initiated by swiping the card through an appropriate reader such as the player terminal card reader 37.

If the player has sufficient funds in their account with gaming system 10, they may purchase one or more game tickets 50 at a POS terminal 31 shown in FIGS. 1 and 2. For each game ticket, the player purchases a desired number of game play outcomes or game plays for the desired game. The game ticket dispenser 45 associated with the POS terminal prints the appropriate information including the ticket indicia on the printed side of the game ticket under the control of ticket production program code executed at the POS terminal. The encoding device associated with game ticket dispenser 45 also encodes the game play information on the game ticket, preferably on the magnetic stripe of the game ticket. The number of plays to be purchased (and printed/encoded on the ticket) is left to the discretion of the player. Depending upon the type of ticket indicia used to represent the game play outcomes and the physical size of the ticket, the player may choose from one play up to 220 or more plays on each game ticket 50.

It will be appreciated that once the game ticket is issued to the player, the ticket indicia (in this case result codes or result indexes) are plainly visible on the ticket, or if a covering material is used as described above, plainly visible after the covering material is removed. The player can go to a published prize table to look up the meaning of the printed codes in terms of the prizes available for the purchased game play outcomes/game records. However, the player has two further options in addition to manually looking up the meaning of the printed ticket indicia. One of these options is to take the issued game ticket to a POS terminal 31 to have the game ticket read by the game ticket reader 46 associated with the terminal. In this case POS terminal 31 communicates with the central computer 24 or 25 servicing that POS terminal in order to obtain the results of the game plays printed on the game ticket.

The other option for revealing the results of the purchased game plays is to take the purchased game ticket to a player terminal to allow the player terminal to reveal the results of the purchased game plays or game play outcomes. The results may be revealed at the player terminal in a fashion to mimic or imitate casino games such as various types of slot machines, draw poker, blackjack, or keno for example, or to mimic other types of games such as bingo. The player terminals 30 may be programmed to imitate one or perhaps several different types of games at the player's choice. A given game representation available to the players through a player terminal may be specific to a particular game set and thus the ticket indicia (result codes/indexes) for plays from the game set and game ticket printed with those indicia may be usable only at a terminal offering that given game or game representation. In some cases, however, the result codes/indexes for a game set may apply to a number of different types of games. In this case the player may take their game ticket to play any one of the number of different types of games to display their game play results.

In the preferred account-based system, even though the player has the option of manually looking up the result codes/indexes in a prize table, the ticket must be redeemed in order to update the player's account with any winnings associated with the game play outcomes represented on the ticket. A player may make a request to redeem their ticket either at a POS terminal 31 or a player terminal 30. At a POS terminal 31 a player's request to obtain the results of their game ticket represents a ticket redemption request. At a player terminal 30, the player's request to see the result of the next outcome represented on the game ticket represents a redemption request as to that outcome or game record. The entire ticket is redeemed at a player terminal 30 by requesting the result for each outcome (i.e., playing each chance on the ticket). In the case of redemption at a POS terminal 31, the player's account is updated with the cumulative winnings for all outcomes represented on the game ticket. In the case of redemption at a player terminal 30 on the other hand, the winnings are applied to the player's account one outcome at a time as the outcomes are played or shown at the player terminal.

Figure 4:
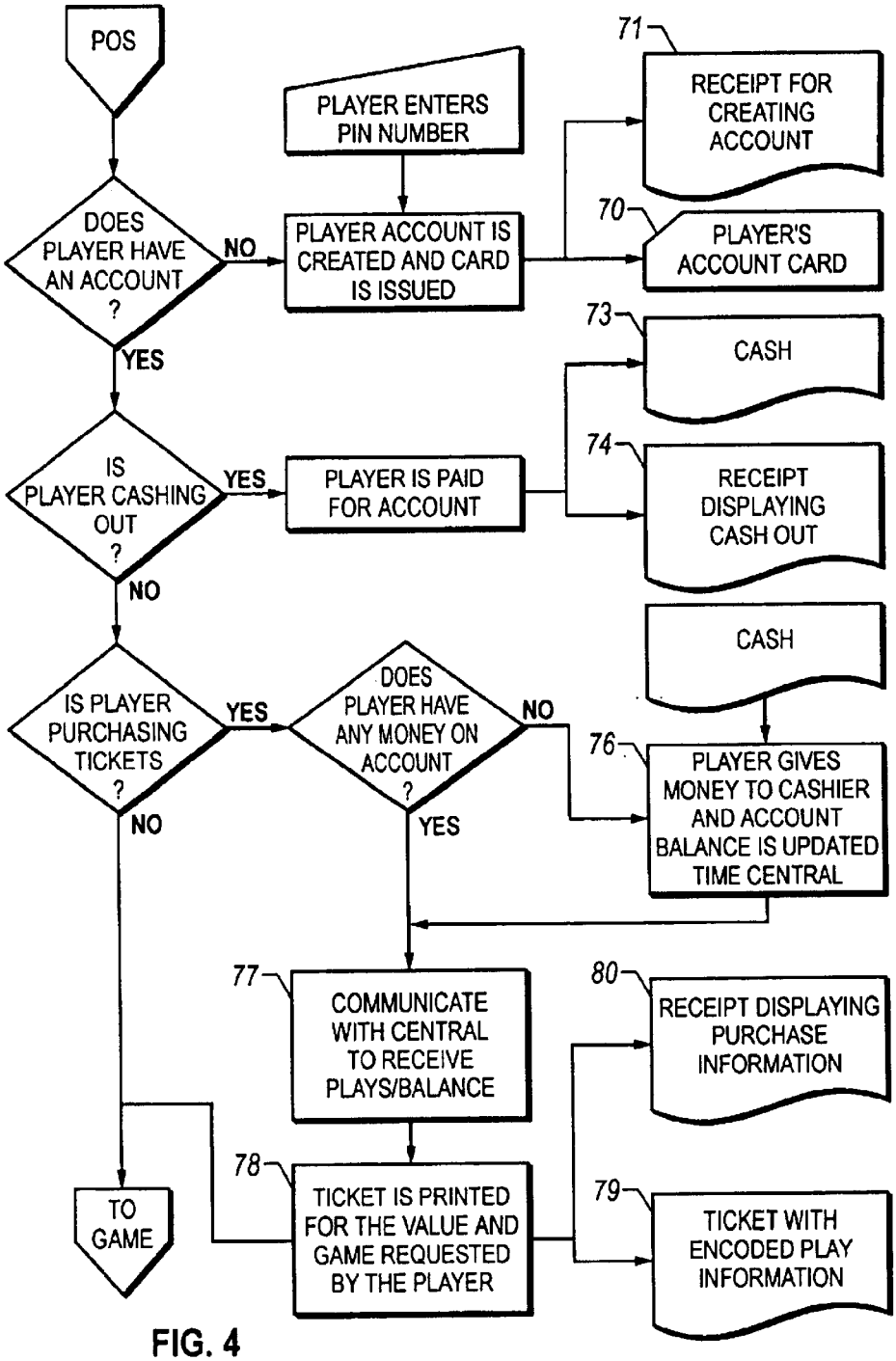
FIG. 4 is a flow chart showing process steps associated with the operation of the point-of-sale terminals.

System processes performed at or through a POS terminal may be described with reference to FIG. 4. The system hardware components referenced in the following discussion of the gaming system 10 are shown in FIGS. 1 and 2. Referring to FIG. 4, if the player does not have an account with the gaming system 10, the player may open an account at a POS terminal 31. The account creation process is performed according to player account program code executed at the POS terminal 31 and includes sending an account request from the POS terminal to the servicing central computer, 24 for example. As will be discussed below with reference to FIG. 6, the central computer returns an account identifier which is encoded onto a player's card at player card printer/encoder 42. The player's account card is then issued as shown at 70. The preferred system also prints an account opening receipt as shown at process block 71 using the printer 43 of the POS terminal. The player can then use the player card to log in at a player terminal 30 as will be discussed further below.

If the player desires to close or cash out their account, POS terminal 31 communicates a cash out request to the central computer 24. Central computer 24 responds with a message indicating the player's account balance. The cashier at the POS terminal 31 may then pay that cash balance to the player as indicated at process block 73 and print a cash out receipt at block 74 using receipt printer 43.

If the player desires to purchase a game ticket at POS terminal 31, the POS terminal operates under the control of ticket request program code executed at the POS terminal to communicate the player's account identifier to the central computer and waits for a response indicating whether the player has sufficient funds in their account for the desired number of plays (each play having a certain purchase price). The determination as to the sufficiency of funds is performed under the control of account comparison program code preferably executed at the central computer 24 or 25 servicing the ticket request. If sufficient funds are not available, the player may give money to the cashier and this amount is entered at the POS terminal and communicated to the central computer to update the player's cash balance as shown at block 76. Once the player has sufficient funds in their account to purchase the desired number of game plays or chances, POS terminal 31 communicates with the central computer as shown at process block 77 to receive the desired number of game play outcomes or results. The ticket indicia representing those game play outcomes identified by the central computer are then printed on the ticket substrate using game ticket dispenser 45 as shown at block 78 under the control of ticket production or printing program code. Also, game ticket dispenser 45 encodes game play information on the game ticket as indicated at process block 79. This game play information encoding is performed under the control of ticket encoding program code executed at the POS terminal 31. In addition to printing and encoding the game ticket, receipt printer 43 at the POS terminal 31 prints a receipt containing purchase information for the purchased game ticket as shown at block 80. In the preferred form of the invention, a set of ticket data is created for each game ticket and stored in a data storage device such as the storage associated with database computer 21. The set of ticket data identifies at least the game play outcomes on the ticket (and more preferably the specific game records assigned to the ticket) and is created and stored under the control of ticket database program code executed by one or more processors in gaming system 10. This set of ticket data is identifiable or retrievable by, or correlated to, the ticket identifier preferably assigned to the respective game ticket. Regardless of how the game play information is encoded on the game ticket and the ticket indicia are applied to the ticket, the player's account is modified by deducting the cost of the game outcomes purchased by the player. This modification is performed under the control of account maintenance program code substantially concurrently with the production of the game ticket. The account maintenance program code may be executed by any suitable processing device or devices associated with gaming system 10.

Figure 5:
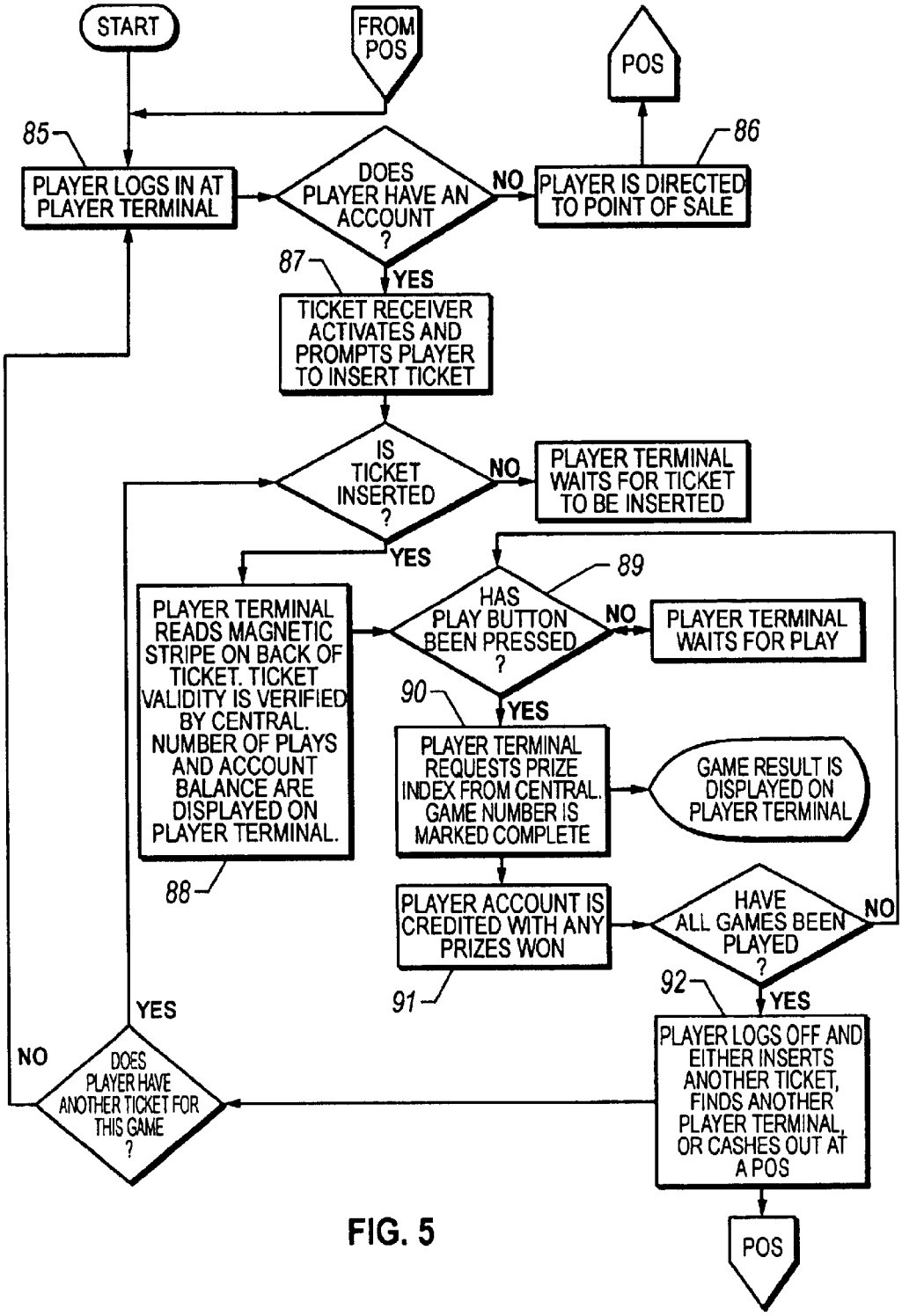
FIG. 5 is a flow chart showing process steps associated with the operation of the player terminals.

Referring now to FIG. 5, the process at the player terminals 30 under the control of player terminal program code includes first logging into the central computer as shown at block 85. In the preferred log in process, the player inserts their player card into the card reader 37 at player terminal 30. This causes a communication to the central computer which causes the central computer to look up the player's account and then returns an indicator whether the account is valid or not. If the account is not valid, player terminal 30 displays a message as indicated at process block 86, directing the player to a POS terminal 31 to open an account. However, if the player does have a valid account, the game ticket reader 38 activates at process block 87 and the player is prompted to insert the desired game ticket (50 in FIGS. 3A and 3B). Once the game ticket is inserted in game ticket reader 38, the reader reads the magnetic stripe 57 on the back of the ticket and communicates with the central computer to verify the validity of the ticket as shown at process block 88. The central computer may also at this stage respond to a verified ticket by communicating to the player terminal 30 the number of plays left on the ticket and the player's account balance. Both of these values are preferably displayed on the display 35 associated with player terminal 30. Alternatively, the central computer returns only the account balance, and the remaining play information may be information encoded on the game ticket itself.

After the number of plays remaining on the game ticket and the account balance are both displayed at the player terminal 30, the player terminal waits for the player to enter a play request or input by pressing a play button or other actuating element associated with the player terminal. When the player makes the play request, the player terminal branches from decision box 89, and at process block 90 uses information from the central computer (or read from the game ticket itself) to display the result of the next game play at the player terminal 30. That play (record) number is also marked used or complete in the back office system records and the player's account is credited with any prize won as shown at process block 91. In the preferred form of the invention, this step of marking the play or record number as complete includes modifying the set of ticket data to indicate that the respective game record has been used/redeemed. Once all game plays have been used, game ticket reader 38 at the player terminal confiscates the completely used ticket and the player may either insert another game ticket or log off the player terminal as indicated at process block 92.

Figure 6:
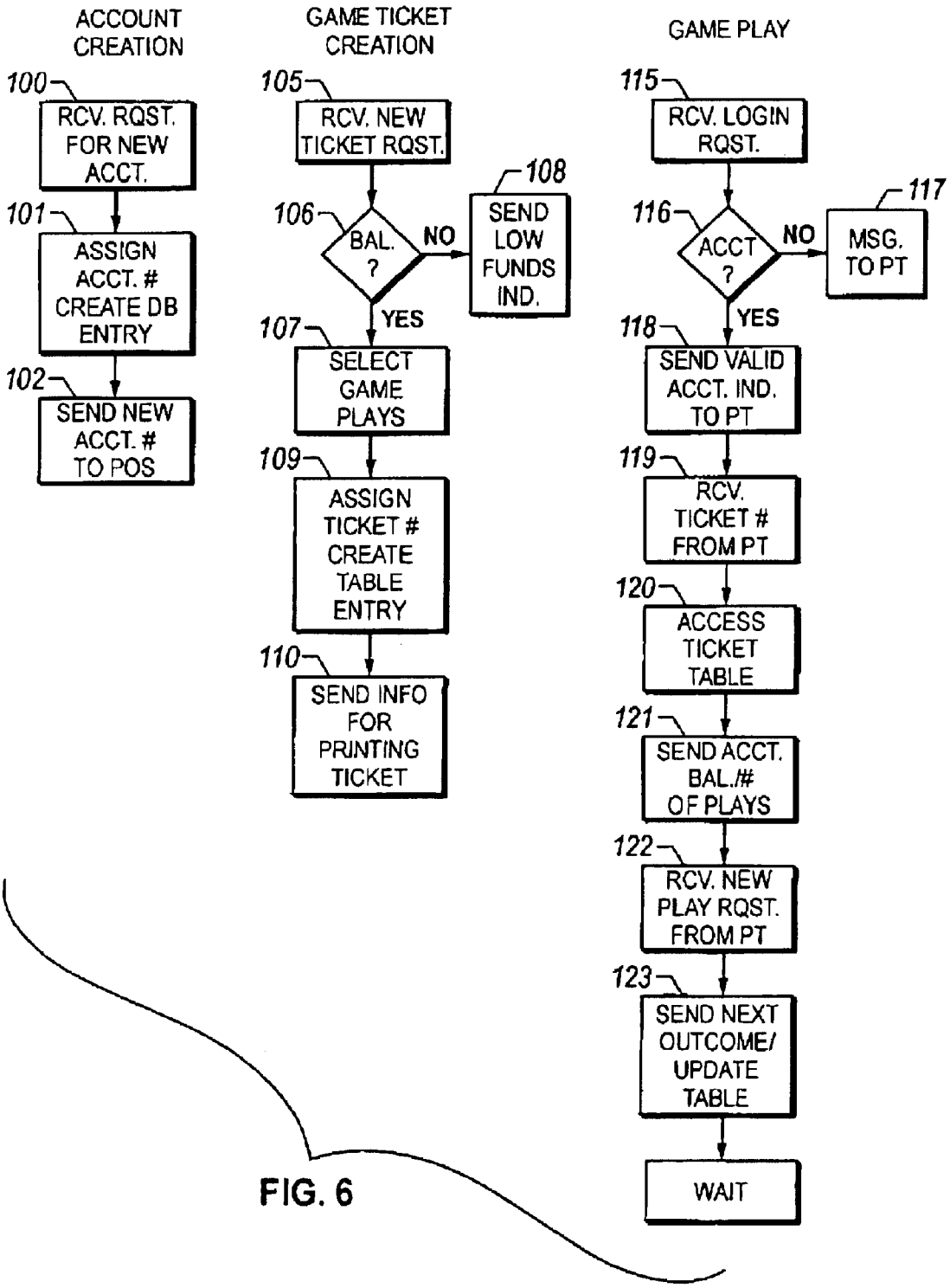
FIG. 6 is a flow chart showing process steps associated with the operation of the central computers.

As shown in FIG. 6, the central computer (24 or 25 shown in FIG. 1) is involved in creating an account, creating a game ticket, and displaying game ticket results at a player terminal 30. The central computer is also involved in sending results to a requesting POS terminal 31 if the player takes the POS terminal option discussed above to obtain their game play results/redeem their game ticket. In creating an account, the central computer receives an account open request from a POS terminal 31 as shown at process block 100. As indicated at process block 101 the central computer cooperates with the database computer 21 to assign a new account number and also creates an entry in the player account table in the database computer under that new account number. At process block 102 the central computer also sends the new account number back to the POS terminal 31 for use in encoding the player card for the new account.

In creating game tickets 50 (FIGS. 3A and 3B), the central computer receives a request for a new game ticket from a POS terminal as shown at process block 105. If after checking the player account table at database computer 21, the central computer determines that the player has sufficient balance for the requested number of plays at decision block 106, the central computer selects the desired number of game records or plays from the indicated game subset as shown at process block 107. In the preferred implementation of the system, the central computer selects the game plays (records) sequentially from the randomized subset of game plays. Alternatively, the game plays may be selected randomly from a sequential list of game records. If the account contains insufficient funds for the requested number of plays, the central computer at process block 108 sends an indicator or message back to the POS terminal indicating that the player has insufficient funds for the requested plays.

In the preferred form of the invention, central computer 24 or 25 (FIG. 1) requests a new game ticket serial number from the database computer 2 land the database computer aft responds by assigning a ticket serial number for the new game ticket being created as shown at process block 109. The particular central computer also preferably causes the database computer 21 to create an entry in a game ticket table stored in the database computer 21. This game ticket table entry or table comprises a set of ticket data and includes the assigned ticket serial number, and preferably all other relevant information regarding the new game ticket including the identifier for the game, the game play outcomes for the purchased game plays and/or the game records or identifiers for the game records, and the player's account number. As shown at process block 110, the central computer also sends sufficient information to the POS terminal 31 to allow POS terminal game ticket dispenser 45 to print and encode the new game ticket. The preferred information for the game ticket is described above with reference to FIGS. 3A and 3B.

In the course of game play at a player terminal 30, the central computer receives a log in request from player terminal as indicated at process block 115 and, by looking up information stored in database computer 21, determines whether the player has a valid account. If the player does not have a valid account as indicated at decision block 116, the central computer at block 117 sends back an indicator which indicates to the player terminal that the player's account is not valid. If the player's account is valid, the central computer at process block 118 notifies the player terminal of the valid account and waits to receive the ticket serial number read at the game ticket reader 38 at the player terminal. Upon receipt of the ticket serial number at process block 119, the central computer accesses the ticket table at database computer 21 to obtain information on the game ticket identified by the serial number. This ticket table access is shown at process block 120 in FIG. 6. The central computer then at process block 121 preferably sends a message back the player terminal with the player's account balance for display at the player terminal 31 and also the number of plays remaining on the ticket. The central computer then waits to receive play requests entered by the player at player terminal 30. Upon receipt of a new play request at block 122, the central computer at process block 123 sends the next outcome or result in the ticket table entry for the given ticket to the player terminal and causes the ticket table entry to be updated to indicate that the particular outcome has been used. The central computer performs this step for each game play request until the plays on the game ticket are exhausted. When all plays on a ticket are used as preferably indicated by the information maintained in the game ticket table, the respective central computer sends a confiscate ticket command to the player terminal from which the last play request was sent. The player terminal 30 responds to this command by directing the ticket reader 38 to confiscate the game ticket and preferably by causing the terminal display 35 to display a message informing the player that the last chance has been played and that a new game ticket is required in order to obtain further chances in the game.

If the player takes the option of determining their game play results instantly at a POS terminal 31, the central computer servicing the particular POS terminal receives an instant result determination or ticket redemption request from the POS terminal in the form of a suitable request code. In response to the request, the respective central computer communicates with database computer 21 to determine the game play results. The particular central computer then communicates the results back to the requesting POS terminal 31. The results may be revealed one at a time or the results may be revealed as a cumulative total of all game play results for the given game ticket. In either case, the results are communicated by a suitable game ticket result device. In the preferred form of the invention, the results for the printed on a receipt provided by printer 43, although other devices may communicate results to the player in some alternative fashion.

Alternatively to the preferred form of the invention in which the central computer creates a game ticket table at the database computer 21, all information regarding the game play outcomes may be encoded on the magnetic stripe or other data carrying media associated with the game ticket. In this case, the central computer may perform a verifying and/or account modification function rather than actually sending the game play outcomes to the player terminal. This verifying function would be performed either for the instant result determination request from a POS terminal or for a game play request from a player terminal The above described preferred embodiments are intended to illustrate the principles of the invention, but not to limit the scope of the invention. Various other embodiments and modifications to these preferred embodiments may be made by those skilled in the art without departing from the scope of the following claims. In particular, the various processing steps described above may be performed by any suitable processing device or devices included in the system. Also, although gaming system 10 is described as a local area network, the gaming system may be implemented as a wide area network with, for example, the back office system located remotely and service casino floor devices at a number of different physical locations.

What is claimed is:

1. A gaming method utilizing a number of stored game records, each game record being associated with a game play outcome, the method including the steps of:

(a) creating a player account for a player, the player account having an account balance;

(b) receiving a game ticket request from the player, the game ticket request identifying a play quantity, the play quantity comprising a value representing a quantity of game play outcomes to be obtained;

(c) determining if the account balance for the player account is sufficient for the play quantity;

(d) in the event that the account balance for the player account is sufficient for the play quantity, applying a number of ticket indicia to a ticket substrate to produce a game ticket, each ticket indicia being directly identifiable, corresponding to a particular one of the game records, and representing the respective game play outcome associated with the particular one of the game records; and (e) applying game play information to the ticket substrate, the game play information being in machine readable form and directly or indirectly specifying each game record associated with the ticket indicia applied to the game ticket.

2. The method of claim 1 wherein the step of applying the game play information includes applying an encoded identifier for each game record represented on the game ticket.

3. The method of claim 1 wherein the step of applying the game play information includes:

(a) applying a first value representing a sequential value correlated to a first game record represented on the game ticket; and (b) applying a second value representing the play quantity.

4. The method of claim 1 wherein the step of applying the game play information includes applying a ticket identifier to the game ticket and further including the step of recording in a data storage device separate from the game ticket a set of ticket data correlated to the ticket identifier, the set of ticket data identifying each game record represented on the game ticket.

5. The method of claim 1 further including the steps of:

(a) distributing the game ticket to the player;

(b) reading the game play information from the game ticket at a player terminal; and (c) for at least one game play outcome represented on the game ticket, displaying a graphic game representation indicating the respective game play outcome represented on the game ticket, each respective graphic game representation being displayed in response to a respective player input made after the step of reading the game play information at the player terminal.

6. The method of claim 5 wherein the step of displaying the graphic game representation comprises displaying a representation related to a casino type game.

7. The method of claim 1 further including the steps of deducting a cost associated with each respective game play outcome represented on the game ticket substantially concurrently with the step of applying the ticket indicia to the ticket substrate and adding a payoff amount associated with at least one such game play outcome in response to a ticket redemption request initiated by the player.

8. The method of claim 1 wherein each ticket indicia comprises an outcome code selected from a set of available outcome codes for a game being played.

9. The method of claim 8 further including the step of displaying a prize table in which each outcome code in the set of available outcome codes is associated with a prize level in the game.

10. The method of claim 1 further including the steps of:

(a) distributing the game ticket to the player;

(b) reading the game play information from the game ticket at a point of sale terminal after the game ticket is distributed to the player; and (c) providing the player with a result of the game ticket in response to reading the game play information.

11. The method of claim 1 further including the step of applying a cover material to the ticket substrate, the cover material obscuring each ticket indicia applied to the ticket substrate.

12. The method of claim 1 further including the step of applying each ticket indicia to the ticket substrate through a cover material which obscures each respective ticket indicia.

13. A program product for use in controlling a game played with a number of stored game records, each game record being associated with a game play outcome, the program product being stored on a computer readable medium and including:

(a) player account program code for creating a player account for a player, the player account having an account balance;

(b) ticket request program code for receiving a game ticket request from the player, the game ticket request identifying a play quantity, the play quantity comprising a value representing a quantity of game play outcomes to be obtained;

(c) account comparison program code for determining if the account balance for the player account is sufficient for the play quantity;

(d) ticket production program code for causing a game ticket dispenser to apply a number of ticket indicia to a ticket substrate to produce a game ticket in the event that the account balance for the player account is sufficient for the play quantity, each ticket indicia being directly identifiable, corresponding to a particular one of game records, and representing the respective game play outcome associated with the particular one of the game records; and (e) ticket encoding program code for causing an encoding device to apply game play information to the ticket substrate, the game play information being in machine readable form and directly or indirectly specifying each game record associated with the ticket indicia represented on the game ticket.

14. The program product of claim 13 wherein the game play information includes an encoded identifier for each game record represented on the game ticket.

15. The program product of claim 13 wherein the game play information includes:

(a) a first value representing a sequential value correlated to a first game record represented on the game ticket; and (b) a second value representing the play quantity.

16. The program product of claim 13 wherein the game play information includes a ticket identifier and further including ticket database program code for causing a data storage device separate from the game ticket to store a set of ticket data correlated to the ticket identifier, the set of ticket data identifying each game record represented on the game ticket.

17. The program product of claim 13 further including player terminal program code for receiving the game play information read from the game ticket at a player terminal and for causing a player terminal display device to display a graphic game representation indicating at least one game play outcome represented on the game ticket, each respective graphic game representation being displayed in response to a respective player input made after the game play information is read from the game ticket at the player terminal.

18. The program product of claim 17 further including account maintenance program code for deducting a cost associated with each respective game play outcome represented on the game ticket in response to the game ticket request and adding a payoff amount associated with at least one respective game play outcome in response to a later redemption request initiated by the player.

19. The program product of claim 13 further including point of sale program code for receiving the game play information read from a reading device associated with a point of sale terminal and for providing the player with a result of the game ticket after reading the game play information.

20. A gaming system which utilizes a number of stored game records, each game record being associated with a game play outcome, the gaming system including:

(a) a player account storage device storing player account data for each game player, the player account data for each player including an account balance for the respective player, (b) a player account processing device for controlling the player account storage device and for comparing the account balance for a respective one of the players with a play quantity in response to a ticket request for the respective player, the play quantity comprising a value representing a quantity of game play outcomes defined in the ticket request for the respective player, (c) a point of sale component for communicating game ticket requests to the player account processing device; (d) a ticket production device associated with the point of sale component, the ticket production device for applying a number of ticket indicia to a ticket substrate to produce a game ticket in the event that the account balance for the respective player account is sufficient for the play quantity specified in a game play request for the respective player, each ticket indicia being directly identifiable, corresponding to a particular one of game records, and representing the respective game play outcome associated with the particular one of the game records; and (e) a ticket encoding device for applying game play information to the ticket substrate, the game play information being in machine readable form and directly or indirectly specifying each game record corresponding to the ticket indicia on the game ticket.

21. The gaming system of claim 20 wherein the game play information includes an encoded identifier for each game record represented on the game ticket.

22. The gaming system of claim 20 wherein the game play information includes:

(a) a first value representing a sequential value correlated to a first game record represented on the game ticket; and (b) a second value representing the play quantity.

23. The gaming system of claim 20 wherein the game play information includes a ticket identifier and wherein the player account storage device is also for storing a set of ticket data correlated to the ticket identifier, the set of ticket data identifying each game record represented on the game ticket.

24. The gaming system of claim 20 further including a player terminal for receiving the game play information read from the game ticket and for displaying a graphic game representation indicating at least one game play outcome represented on the game ticket, each respective graphic game representation being displayed in response to a respective player input at the player terminal made after the game play information is read from the game ticket at the player terminal.

25. The gaming system of claim 20 wherein the account processing device is also for deducting a cost associated with each respective game play outcome represented on the game ticket in response to the game ticket request and adding a payoff amount associated with at least one respective game play outcome in response to a later redemption request.

26. The gaming system of claim 20 wherein the point of sale component includes a game ticket reading device and is also for receiving the game play information from the game ticket reading device associated with a point of sale terminal and for providing the player with a result of the game ticket after reading the game play information.

27. A gaming system utilizing a number of stored game records, each game record being associated with a game play outcome, the gaming system including:

(a) a point of sale component for receiving a game ticket request from a player, the game ticket request identifying a play quantity comprising a value representing a quantity of game play outcomes to be obtained;

(b) a game ticket dispenser for applying a number of ticket indicia to a ticket substrate to produce a game ticket in response to the game ticket request, the number of ticket indicia applied being equal to the play quantity, each ticket indicia being directly identifiable, corresponding to a particular one of the game records, and representing the respective game play outcome associated with the particular game record;

(c) a ticket data storage device separate from the game ticket for storing a set of ticket data correlated to a ticket identifier associated with the game ticket, the set of ticket data identifying each game record represented on the game ticket by the ticket indicia; and (d) a player terminal operatively connected for communication with the ticket data storage device, the player terminal for communicating ticket usage information to the ticket data storage device in response to each game play input entered by a player at the player terminal.

28. The gaming system of claim 27 further including:

(a) a ticket encoding device for applying the ticket identifier to the game ticket.

29. The gaming system of claim 27 further including:

(a) a ticket reader device for reading the ticket identifier from the game ticket; and (b) a processing device for locating the stored set of ticket data for the game ticket using the ticket identifier read from the game ticket and for reading ticket result information from the set of ticket data after locating the set of ticket data using the ticket identifier.

30. The gaming system of claim 29 wherein the ticket reader is included in the player terminal and further including a player terminal display for displaying a graphic game representation indicating a respective one of the game play outcomes represented on the game ticket, the graphic game representation being displayed in response to a game play request made after the processing device reads ticket result information from the set of ticket data.

31. The gaming system of claim 29 wherein the ticket reader is included in the point of sale terminal and wherein the point of sale terminal includes a game ticket result device for providing the player with a result of the game ticket.

* * * * *